US010005589B2

(12) United States Patent
Shakeri Clark

(10) Patent No.: US 10,005,589 B2
(45) Date of Patent: Jun. 26, 2018

(54) TWO-IN-ONE DRINKING VESSEL

(71) Applicant: Marjaneh Shakeri Clark, Fairfax, VA (US)

(72) Inventor: Marjaneh Shakeri Clark, Fairfax, VA (US)

( * ) Notice: Subject to any disclaimer, the term of this patent is extended or adjusted under 35 U.S.C. 154(b) by 0 days. days.

(21) Appl. No.: 15/403,630

(22) Filed: Jan. 11, 2017

(65) Prior Publication Data

US 2018/0029752 A1 Feb. 1, 2018

Related U.S. Application Data

(60) Provisional application No. 62/494,042, filed on Jul. 26, 2016.

(51) Int. Cl.

| | |
|---|---|
| ***B65D 25/04*** | (2006.01) |
| ***B65D 43/02*** | (2006.01) |
| ***B65D 47/06*** | (2006.01) |
| ***B65D 47/32*** | (2006.01) |
| ***B65D 43/20*** | (2006.01) |
| ***B65D 81/38*** | (2006.01) |
| ***B65D 51/18*** | (2006.01) |
| ***A47G 19/22*** | (2006.01) |

(52) U.S. Cl.

CPC ..... *B65D 25/04* (2013.01); *A47G 19/2272* (2013.01); *A47G 19/2288* (2013.01); *B65D 43/0225* (2013.01); *B65D 43/20* (2013.01); *B65D 47/06* (2013.01); *B65D 47/32* (2013.01); *B65D 51/18* (2013.01); *B65D 81/3865* (2013.01); *B65D 2251/009* (2013.01); *B65D 2251/0018* (2013.01); *B65D 2251/0025* (2013.01); *B65D 2251/0028* (2013.01); *B65D 2251/0081* (2013.01); *B65D 2251/0087* (2013.01); *B65D 2543/00046* (2013.01)

(58) Field of Classification Search

CPC .... B65D 25/04; B65D 43/0225; B65D 47/06; B65D 47/32

USPC ..... 220/577, 524, 592.17, 23.83, 506, 906

See application file for complete search history.

(56) References Cited

U.S. PATENT DOCUMENTS

| | | | | |
|---|---|---|---|---|
| 4,919,295 | A | 4/1990 | Hitzler | |
| 4,955,503 | A | 9/1990 | Propes | |
| 5,934,501 | A * | 8/1999 | Wright | A47G 19/2211 220/23.83 |
| 7,165,697 | B1 | 1/2007 | Checkalski | |
| D689,739 | S | 9/2013 | Schmitt | |
| 8,733,578 | B2 | 5/2014 | Michaels | |

(Continued)

*Primary Examiner* — King M Chu

(74) *Attorney, Agent, or Firm* — Maier & Maier, PLLC

(57) ABSTRACT

A two-in-one drinking vessel having a body portion with a sidewall forming an outer compartment, and an inner compartment disposed within the outer compartment. The inner compartment may be fixedly or removably attached to the body, or attached to a lid. Each of the compartments may be open at the top and may have a threaded upper portion by which the lid can be attached. The outside of the lid may sealably attach to the outer compartment, and a fluid passage on the inside of the lid may sealably attach to the inner compartment. At least two orifices having closures, one connected to the outer compartment and one connected to the fluid passage, may be disposed on the lid, which may allow a user to drink from the outer compartment out of one orifice and the inner compartment out of another orifice.

20 Claims, 9 Drawing Sheets

(56) References Cited

U.S. PATENT DOCUMENTS

| | | | |
|---|---|---|---|
| 2009/0127263 | A1 | 5/2009 | Hylton |
| 2009/0272747 | A1 | 11/2009 | Kalaouze, Jr. |

* cited by examiner

TWO-IN-ONE DRINKING VESSEL

CLAIM OF PRIORITY

This application claims priority from U.S. Provisional Patent Application No. 62/494,042, filed on Jul. 26, 2016, entitled "Tumbler/Thermos 2 in 1," the entire contents of which are hereby incorporated by reference.

BACKGROUND

Divided or partitioned drinking cups or other drinking vessels having multiple chambers for retaining liquid have long been known in the art. Typically, these drinking cups comprise a cup for a hot or a cold drink, which is split into chambers of roughly equal size by a number of fixed dividers originating radially from the center of the cup. The most common such cups will have two chambers of substantially equal size, separated by a divider running down the center of the cup.

Several different variants or purposes of multiple-chambered drinking cup are understood. Common varieties are dual-chambered plastic soft drink cups intended to allow a customer to be served two different flavors of soft drink, or dual-chambered drinking mugs intended to be used by two different people (such as a dating couple) at the same time.

However, existing drinking vessels with multiple chambers suffer from a number of downsides. First, because chambers are often of a fixed, narrow size, the drinking vessels can be difficult to clean. This inflexibility can also be user-unfriendly; because the chambers are of a fixed and usually equal size, a user of a multiple-chambered drinking vessel who wishes to fill it with multiple kinds of drink typically has little option but to fill the vessel with roughly equivalent amounts of each kind of drink, or to leave the vessel substantially underfilled. Second, existing multiple-chambered drinking vessels may have chambers of undesirable shape. In the vast majority of cases, the chambers of a multiple-chambered drinking vessel are formed side-by-side with each other, with each of the chambers contacting the edge of the drinking vessel. This can be undesirable from a heat transfer perspective, as particularly hot or cold drinks will tend to lose or gain heat from the surroundings of the cup despite the insulation that typically be present.

SUMMARY

A "two-in-one" drinking vessel having multiple chambers may be disclosed. Such a vessel may include a body portion having a sidewall forming an outer compartment, and an inner compartment disposed in the outer compartment, for example concentrically, and which may be attached to the body portion either fixedly or removably or may be suspended within the body portion. Each of the outer compartment and the inner compartment may be open at the top and may have a threaded upper portion. The inner compartment may be substitutable for a different inner compartment, such as an inner compartment of a different size or a porous inner compartment designed for steeping tea, as may be desired.

The drinking vessel may further include a lid, which may include an outside rim adapted to sealably interface with the threaded upper portion of the outer compartment, and a fluid passage having a fluid passage rim adapted to sealably interface with the threaded upper portion of the inner compartment. The lid may further include a plurality of closures, such as sippers or mouthpieces, shiftable between an open and a closed state, the closures each unsealing at least one vent hole when in an open state and sealing the at least one vent hole when in a closed state, wherein an outer compartment closure in the plurality of closures is configured to unseal a fluid orifice of the outer compartment when in an open state and seal the fluid orifice of the outer compartment when in a closed state, and wherein an inner compartment closure in the plurality of closures is configured to unseal a fluid orifice of the fluid passage when in an open state and seal the fluid orifice of the fluid passage when in a closed state. Optionally, the closures may include a restoring component, such as a spring, which may tend to close the closure when the user is not holding it open. Closures may also be substitutable for different closures, if desired.

BRIEF DESCRIPTION OF THE FIGURES

Advantages of embodiments of the present invention will be apparent from the following detailed description of the exemplary embodiments thereof, which description should be considered in conjunction with the accompanying drawings in which like numerals indicate like elements, in which.

DETAILED DESCRIPTION

Aspects of the invention are disclosed in the following description and related drawings directed to specific embodiments of the invention. Alternate embodiments may be devised without departing from the spirit or the scope of the invention. Additionally, well-known elements of exemplary embodiments of the invention will not be described in detail or will be omitted so as not to obscure the relevant details of the invention. Further, to facilitate an understanding of the description discussion of several terms used herein follows.

As used herein, the word "exemplary" means "serving as an example, instance or illustration." The embodiments described herein are not limiting, but rather are exemplary only. It should be understood that the described embodiments are not necessarily to be construed as preferred or advantageous over other embodiments. Moreover, the terms "embodiments of the invention", "embodiments" or "invention" do not require that all embodiments of the invention include the discussed feature, advantage or mode of operation.

According to an exemplary embodiment, and referring generally to the Figures, various exemplary implementations of a two-in-one drinking vessel having multiple chambers may be disclosed. According to an exemplary embodiment, a drinking vessel, such as a drink tumbler or thermos, may have a plurality of separate compartments which may each be configured to hold a separate beverage or other liquid.

Figure 1:
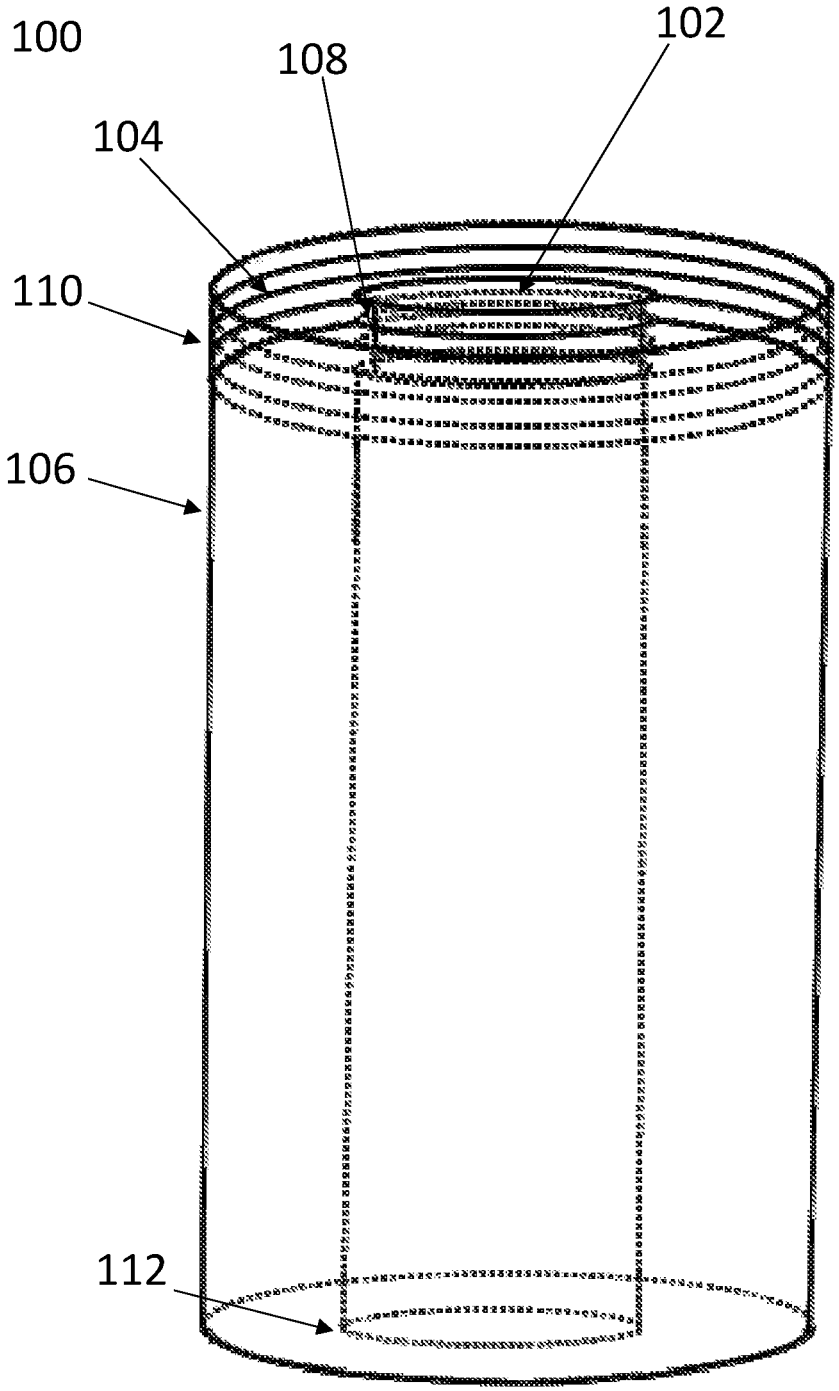
FIG. 1 is an exemplary embodiment of a body portion of a drinking vessel.

Turning now to exemplary FIG. 1, FIG. 1 displays an exemplary embodiment of the body portion of a drinking vessel 100. The body portion of a drinking vessel 100 may have an outer compartment 104, or more than one outer compartment 104, which may be formed around the outer portion of the body portion of the drinking vessel 100 and may, if desired, be formed from the side wall 106 of the drinking vessel. In other embodiments, the outer compartment 104 may be separate from the side wall 106, and may be, for example, an insertable liner. The body portion 100 may also have an inner compartment 102, or more than one inner compartment 102, separate from the outer compartment 104 and which may be located inside the outer compartment 104. Both of the inner compartment 102 and the outer compartment 104 may be open on the top. Each of the inner compartment 102 and the outer compartment 104 may have a threaded portion 108, 110, or another coupling such as a snap fit, to which a lid or other suitable structure may be attached.

According to an exemplary embodiment, the outer compartment 104 and the inner compartment 102 may be tubular, or may have any other radial or cross-sectional shape, as desired. For example, in an exemplary embodiment, one or both of the compartments may have a hexagonal shape, or may have another multi-sided figure as a cross-section, if desired. The outer compartment 104 and inner compartment 102 may also have any appropriate shape in the vertical direction. For example, each of the outer compartment 104 and the inner compartment 102 may be straight in the vertical direction. In another example, each of the outer compartment 104 and the inner compartment 102 may be sloped or curved such that one or both of the compartments forms, for example, a cone shape or flattened cone shape. In another example, the outer compartment 104 may have a thinner lower section and a wider upper section, such as to allow the outer compartment 104 to be inserted into a cupholder, such as a cupholder of a vehicle, without unduly limiting the volume of the outer compartment 104. Either or both of the compartments may also have any other shape, as may be desired.

In some embodiments, the body portion 100 may have an insulated side wall 106, which may reduce the rate of heat exchange between the drinking vessel and its environment, helping cold drinks stay cold and hot drinks stay hot longer. For example, the side wall 106 may be double-walled, vacuum-filled, or otherwise insulated, as desired. In some embodiments, the inner compartment 102 may be separately insulated from the outer compartment 104; this may enable liquids to be kept inside each of the compartments at different temperatures without rapid heat transfer between the two compartments, should this be desired. In some exemplary embodiments, the outer compartment 104 may itself be used in order to provide insulation to the inner compartment 102. For example, if desired, the outer compartment 104 may be left empty or may be filled with an insulating material in order to better insulate the inner compartment 102 from the outside environment.

In some exemplary embodiments, the outer 104 and inner compartments 102 may each store a different type of liquid. In other exemplary embodiments, only one type of liquid may be kept inside each of the compartments 102, 104. For example, according to an exemplary embodiment, the same kind of drink, for example hot coffee, may be stored in each of the inner compartment 102 and the outer compartment 104, so that a user can drink from one of the compartments while leaving the other compartment sealed shut. This may limit the total heat loss to the coffee (or heat loss or gain to whatever other beverage may be stored in each compartment 102, 104 of the body portion 100) that may be caused by accessing one of the compartments to drink from it, as the coffee in the compartment not accessed will remain sealed from the environment. This may allow a user to, for example, enjoy half of a container of hot coffee early in the morning and the other half of the container later on in the day, without refilling the container and without substantial losses of heat to the air in the container.

In some embodiments, the bottom portion of the outer compartment 104 and/or the bottom portion of the inner compartment 102 may be insulated. In some embodiments, different amounts of insulation may be present on each of the outer compartment 104 and the inner compartment 102; for example, in one exemplary embodiment, one of the outer compartment 104 and the inner compartment 102 may be configured to be a dedicated cold drink compartment and the other of the outer compartment 104 and the inner compartment 102 may be configured to be a dedicated hot drink compartment, and the compartment that is configured to be the dedicated cold drink compartment may have more insulation at the bottom portion of the compartment. In another exemplary embodiment, the level of insulation provided in the outer compartment 104 and/or the inner compartment 102 may be adjustable, for example by removing an inner compartment 102 having one level of insulation in the lower portion, and substituting it for an inner compartment 102 having a different level of insulation in the lower portion.

According to some exemplary embodiments, the inner compartment 102 may be permanently affixed to the body portion 100, such as to the bottom surface of the body portion 100. In other exemplary embodiments, the inner compartment 102 may be removably coupled to the body portion 100 at one or more mounting sites 112. In some exemplary embodiments, the inner compartment 102 may be coupled to the outer compartment 104 by a snap fit or press fit. For example, according to an exemplary embodiment, the inner compartment 102 may have a protruding ring disposed on the bottom surface and arranged concentrically with the side of the inner compartment 102. A matching circular slot may be formed on the upper surface of the bottom of the outer compartment 104. The inner compartment 102 may be attached to the outer compartment 104 by pressing the protruding ring into the matching circular slot, creating a secure seal that allows the inner compartment to be easily removed. In other exemplary embodiments, the inner compartment 102 may be mounted to the body portion 100 via a connection such as another type of snap fit or press fit, or a threaded connection. In other exemplary embodiments, the inner compartment 102 may be coupled to a lid instead of to a body portion 100, if desired. In still other exemplary embodiments, inner compartments 102 may be attachable to other inner compartments 102, such as inner compartments 102, so that multiple inner compartments 102 (such as multiple concentrically arranged inner compartments 102) may be present within a container.

In some exemplary embodiments, a removably coupled inner compartment 102 may be interchangeable with another inner compartment 102. For example, according to an exemplary embodiment, a removable inner compartment 102 may be removed and replaced with an inner compartment 102 of a different size. In another exemplary embodiment, the mounting site 112 of the body portion 100 or the lid may be configured to accept different types of inner compartments; for example, in one exemplary embodiment, an uninsulated inner compartment 102 may be removed and replaced with an insulated inner compartment 102, which may allow beverages to be kept within the container at different temperatures, if desired. Alternatively, an insulated inner compartment 102 may be exchanged for an uninsulated inner compartment 102 in order to save space or should heat transfer between the compartments be desired. (For example, in order to keep coffee in the outer compartment 104 warm, the inner compartment 102 may be filled with very hot tea, which has been raised to a temperature where burning would be a concern for the coffee. This may ensure that, for a while, the coffee in the outer compartment 104 is receiving heat from its surroundings as well as losing it, thus ensuring that the coffee in the outer compartment stays warm longer.) In some cases, a user may even wish to remove a modular inner compartment entirely in order to use the body portion 100 as a container for a single drink.

Another type of inner compartment 102 that may be envisioned is a porous inner compartment 102, or an inner compartment 102 that is configured to create an imperfect seal, which may be used for slowly combining beverages or other material. For example, in an exemplary embodiment, this may be used for steeping tea. In another exemplary embodiment, the inner compartment 102 may be configured to quickly combine beverages or other material stored in the outer compartment 104 and inner compartment 102; this may be used to store, for example, mixed alcoholic drinks that are intended to be consumed immediately after they are mixed.

According to an exemplary embodiment, the body portion 100 and the inner compartment 102 may be formed from any material or combination of materials. For example, in an exemplary embodiment, the body portion 100 and/or the inner compartment 102 may be formed from metal (such as, for example, stainless steel), plastic, silicone, or another suitable material or combination of suitable materials, as may be desired. Material may also be opaque, translucent, or transparent, as desired; in some embodiments, a transparent material may be used for the side wall 106 of the body portion 100 such that the inner compartment 102 can be easily seen when in use, while in other embodiments a translucent or opaque material may be used.

The threaded portions 108, 110 or other upper coupling structures of the inner compartment 102 and the outer compartment 104 may be configured to accept any of a variety of lid designs. For example, in an exemplary embodiment, a two-in-one drinking vessel may have different styles of lid for cold beverages and for hot beverages, and each may be attached based on the contents of the vessel. In another embodiment, a lid may be modified between different configurations, for example a hot beverage configuration and a cold beverage configuration, or any other configuration, as may be desired.

Figure 2A:
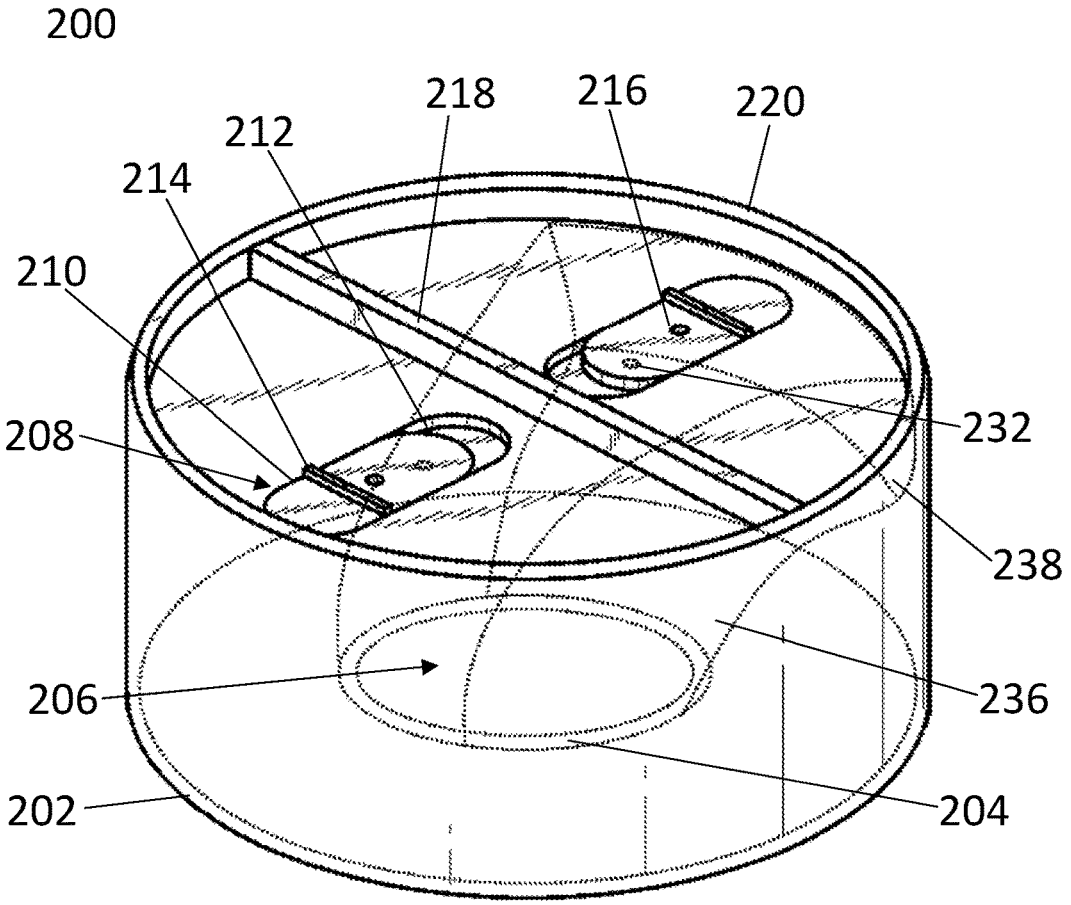
FIG. 2A is an exemplary embodiment of a lid of a drinking vessel.

Turning now to exemplary FIG. 2A, FIG. 2A displays an exemplary embodiment of a lid 200 configured to be attached to the body portion of a drinking vessel 100. A lid 200 may have an outer threaded portion 202 configured to be attached to the outer compartment 104 of a body portion 100, an inner threaded portion 204 configured to be attached to the inner compartment 102 of the body portion 100, and a built-in fluid passage or canal 206 which may be connected in series with the inner compartment 102 of the body portion 100. In some exemplary embodiments, the fluid passage 206 may have any of a variety of shapes. For example, in some exemplary embodiments, the fluid passage 206 may have a curved or a bowl shape; in other exemplary embodiments, the fluid passage 206 may be conical; and in other exemplary embodiments, the fluid passage 206 may have any other shape.

For example, according to an exemplary embodiment, a lid 200 may have a fluid passage 206 that is attached to the outer wall of the lid 200. For example, in an exemplary embodiment, a lower portion 236 of the fluid passage 206 may extend from an inner threaded portion 204 of the lid to an outer wall of the lid 200. In an exemplary embodiment, the fluid passage 206 may then extend upwards along the wall of the lid 200. In an exemplary embodiment, the wall of the fluid passage 206 that extends upward along the outer wall of the lid 200 may be a combined wall 238, such that the wall of the fluid passage 206 is also the wall of the outer portion of the lid 200, or such that the wall of the fluid passage 206 is fused with the outer wall of the lid 200. In an alternative embodiment, the wall of the fluid passage 206 may be separate from the wall of the lid 200, which may allow, for example, the fluid passage 206 to be removed from the lid 200 temporarily for cleaning, if desired.

The lid 200 may also have one or more closures which may be connected to, and which may allow a user to drink from, an outer compartment 104 of the body portion 100 and an inner compartment 102 of the body portion. For example, in an exemplary embodiment, a sipper 208 may be located over the outer compartment 104 of the body portion 100 such that opening the sipper 208 exposes an orifice permitting access to the contents of the outer compartment 104, and another sipper 208 may be located over the fluid passage 206 such that opening that sipper exposes an orifice permitting access to the contents of the inner compartment 102. In other exemplary embodiments, other closures, such as spouts or twist-off lids, may be used in place of sippers 208, as desired. Variations of sippers 208 may also be understood; for example, in an exemplary embodiment, a sipper 208 closure may be left-to-right or rotational instead of front-to-back as depicted in FIG. 2A. In still other exemplary embodiments, a lid 200 may be modular such that a closure may be substituted for a different type of closure; for example, in an embodiment, a sipper 208 may be removed from the lid 200, exposing an opening, and another type of closure, such as a spout, may be pressed or otherwise fitted into place in its place. In some embodiments, the closures may be self-sealing; for example, in an exemplary embodiment, a sipper 208 or other closure may be spring-loaded such that it closes when not held open by a user, or may have an alternative restoring component tending to apply a closing force to the closure when open, as desired.

In an exemplary embodiment, a sipper 208 may include a sliding closure 210, a sipper panel 212 on which the sliding closure 210 slides, and a raised sliding grip 214 with which a user may operate the sliding closure 210 and move it back and forth. In some embodiments, a raised sliding grip 214 may be substituted with, for example, a higher-friction portion of the sliding closure 210, such that a user can press their finger on the sliding closure 210 and move it back and forth. The lid 200 may also include one or more vent holes 216 configured to allow the passage of air, which may be located in the sliding closures 210 or elsewhere on the lid 200. For example, in one exemplary embodiment, vent holes 216 may be placed on the sliding closures 210 such that, when the sliding closures 210 are in an open position, the vent holes 216 align with other holes 232 in the sipper panel 212 and allow the passage of air, while when the sliding closures 210 are in a closed position, the vent holes 216 and the sipper panel holes 232 are not aligned and no air is permitted to flow through the vent holes 216.

In an exemplary embodiment, a lid 200 may have a raised outer portion 220, and may include a dividing wall 218 placed to divide the closures from each other. This may help ensure that the contents of the drinking vessel do not spill or mix on the lid 200.

In some exemplary embodiments, the surface of the lid 200 may be flat or substantially flat, though in some embodiments may have raised or lowered features such as a dividing wall 218. In other exemplary embodiments, a portion of the lid 200 may be sunk a short distance into the lid 200, so that, for example, an outer part of the lid 200 and an inner part of the lid 200 are at different heights. In other exemplary embodiments, the surface of the lid 200 may be curved, or may be other than flat; for example, in an exemplary embodiment, the surface of the lid 200 may dip slightly downward and be outwardly concave, and in another exemplary embodiment, the surface of the lid 200 may extend slightly upward and be outwardly convex or dome-shaped. According to such an embodiment, the sippers 208 may be formed to fit the non-flat surface of the lid 200. For example, according to an exemplary embodiment, the sippers 208 may likewise be curved, such that, for example, a sliding closure 212 may slide in an angular or tangential direction along the surface of a convex lid 200. In another exemplary embodiment, the lid 200 may have flat portions in which the sippers 208 may be disposed.

Figure 2B:
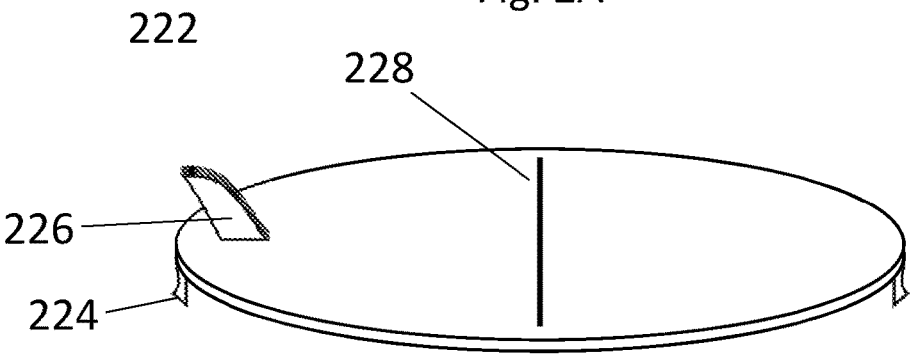
FIG. 2B is an exemplary embodiment of a removable cap configured to be coupled to a lid of a drinking vessel.

Turning now to exemplary FIG. 2B, in some embodiments, a lid 200 may further include a removable cap 222 configured to fit over some or all of the other components of the lid 200, such as the sippers 208 or other closures or the dividing wall 218. In some embodiments, removable cap 222 may create a tight seal and may protect against liquid exiting or entering into a closure of the lid 200. In some exemplary embodiments, the removable cap 222 may seal to the lid 200 such that an air pocket is created when the removable cap 222 is put in place on the lid 200. This may contribute to the ability of the lid 200 to retain heat, allowing hot drinks to be kept warm for a longer time. In another embodiment, removable cap 222 may merely cover the lid 200 and protect against other material coming into contact with the lid 200.

Removable cap 222 may attach to the top of the lid 200 by one or more connectors 224. For example, according to an exemplary embodiment, a removable cap 222 may have one or more snap fit connections 224, which may fit within the raised outer portion 220 of the lid 200 and which may be held in place by a lip of the raised outer portion of the lid. Alternatively, the removable cap 222 may couple to a lid 200 by another type of connector 224 or by another connection type; for example, in an exemplary embodiment, a removable cap 222 may screw onto a lid 200 by a threaded connection extending around the rim of the removable cap 222 and the lid 200.

A removable cap 222 may further include one or more handles or pull-tabs 226 that can be used in order to remove the removable cap 222 from the lid 200. Alternatively, a removable cap 222 may be removable by another method other than by the use of a pull-tab 226; for example, in an exemplary embodiment wherein the removable cap 222 is connected to the lid 200 with a threaded connection and is unscrewable, the removable cap 222 may be removed by, for example, gripping the perimeter of the removable cap 222 and turning it in a particular direction to release the threaded connection, and no pull-tab 226 may be necessary.

In some exemplary embodiments, a removable cap 222 may have a particular geometry structured to fit over the geometry of the lid 200. For example, in an exemplary embodiment, a removable cap 222 may have a slot 228 cut in the middle of the removable cap 222, which may be sized to fit over a dividing wall 218 of the lid 200. In another embodiment, the removable cap 222 may be other than flat and may have a raised inner portion, or a raised outer portion, sized to fit over one or more sippers 208 or other closures. For example, in an exemplary embodiment, the removable cap 222 may be convex or domed, such that it can fit over a closure that is raised above the surface of the lid 200.

Other accessories other than a removable cap 222 may also be understood. For example, in an exemplary embodiment, a body portion of a drinking vessel 100 may have a handle or strap attached to it, or may have one or more sites at which a handle or strap may be attached. This may allow the drinking vessel to be easily carried, if desired.

Figure 2C:
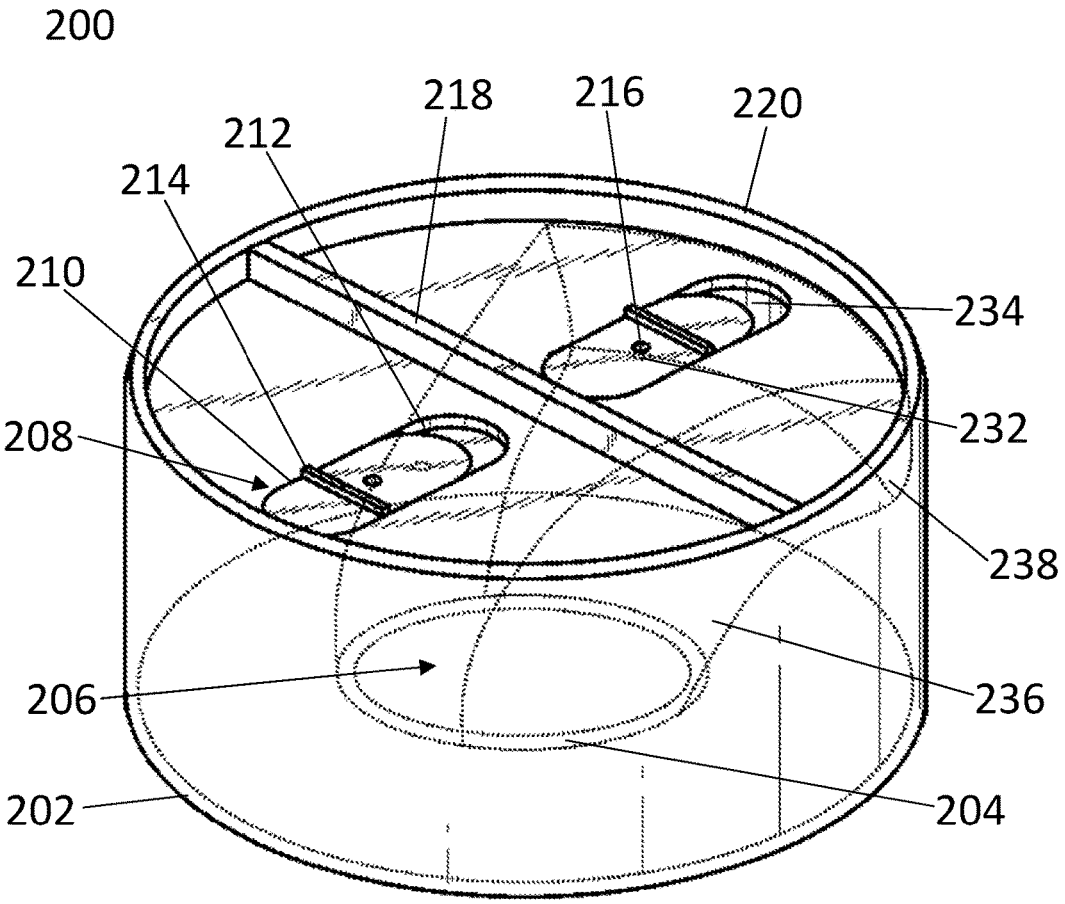
FIG. 2C is an exemplary embodiment of a lid of a drinking vessel.

Turning now to exemplary FIG. 2C, FIG. 2C displays an exemplary embodiment of a lid 200 configured to be attached to the body portion of a drinking vessel 100. According to an exemplary embodiment, the lid 200 may include one or more vent holes 216 configured to allow the passage of air, which may be located in the sliding closures 210 or elsewhere on the lid 200, and which may be brought into alignment with sipper panel holes 232. Opening a sliding closure 210 may also expose the fluid passage or canal 206, which may allow a user to pour liquid from or drink liquid from an opening 234 in the lid 200 that was formerly sealed by the sliding closure 210. The aligned holes 216, 232 may allow the passage of air while the user is pouring liquid from or drinking liquid from the opening 234, ensuring that pressure within the drinking vessel 100 is equalized and ensuring that the liquid inside the drinking vessel can be poured easily.

Figure 2D:
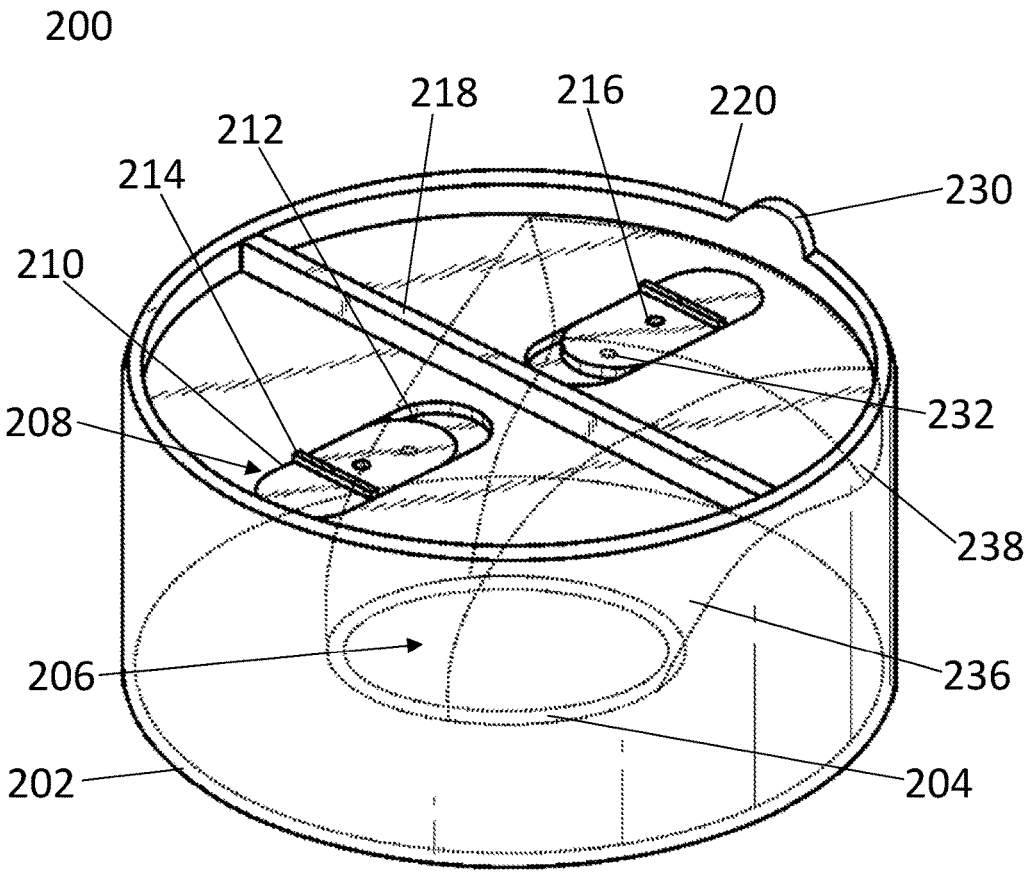
FIG. 2D is an exemplary embodiment of a lid of a drinking vessel.

Turning now to exemplary FIG. 2D, FIG. 2D displays an exemplary embodiment of a lid 200 configured to be attached to the body portion of a drinking vessel 100. In an exemplary embodiment, a lid 200 may include one or more raised lips 230, which may serve as a drinking lip for a user of a drinking vessel.

In some exemplary embodiments, the one or more raised lips 230 may be disposed around the rim or raised outer portion 220 of the lid 200 and may be incorporated into the material of the lid 200. In other exemplary embodiments, the one or more raised portions 230 may be incorporated into the geometry of one or more of the sippers 208. In an exemplary embodiment wherein the one or more sippers 208 may be added or removed in order to exchange them for other closures, the one or more raised portions 230 may likewise be added or removed, as may be desired.

Figure 2E:
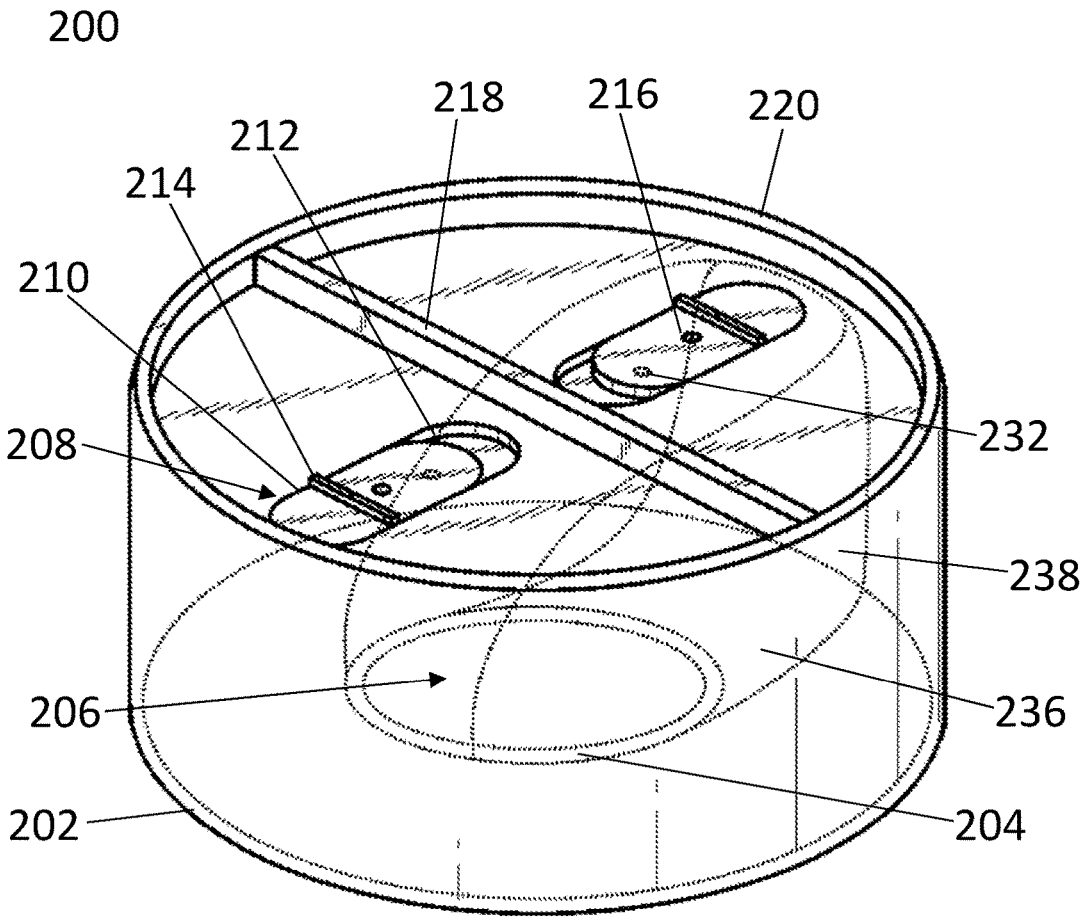
FIG. 2E is an exemplary embodiment of a lid of a drinking vessel.

Turning now to exemplary FIG. 2E, FIG. 2E displays an exemplary embodiment of a lid 200 configured to be attached to the body portion of a drinking vessel 100. In an exemplary embodiment, a lid 200 may have a fluid passage 206 with an alternative shape, which may, for example, extend down to the bottom portion of the inner space of the lid 200. In such an exemplary embodiment, the fluid passage 206 may fill more of the internal volume of the lid 200; for example, in an exemplary embodiment, the expanded fluid passage 206 may fill approximately one quarter to one third of the total internal volume of the lid 200.

In some exemplary embodiments, an expanded fluid passage 206 may be used alongside sippers 208. In other exemplary embodiments, an expanded fluid passage 206 may be paired with another method of accessing the internal contents of the expanded fluid passage 206; for example, the expanded fluid passage 206 may be sized in order to accommodate a straw inserted through an enlarged sipper 208 or other top closure. In such an embodiment, it may be desirable to include a substantial amount of vertical space in the fluid passage 206 such that the straw can be inserted through the sipper 208 and retained in the fluid passage 206, while still including a curved lower portion 236 such that the straw is guided through the inner threaded portion 204.

Figure 2F:
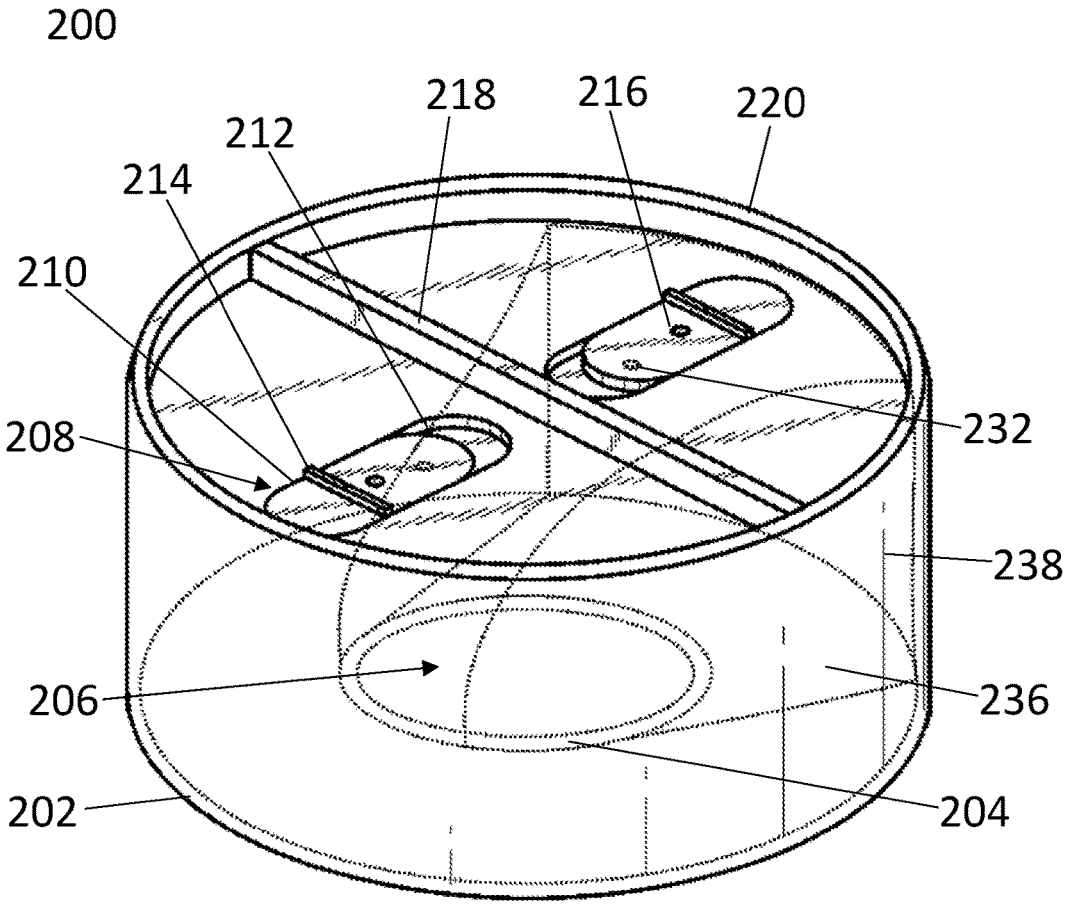
FIG. 2F is an exemplary embodiment of a lid of a drinking vessel.

Turning now to exemplary FIG. 2F, FIG. 2F displays an exemplary embodiment of a lid 200 configured to be attached to the body portion of a drinking vessel 100. In an exemplary embodiment, a lid 200 may have an even more expansive fluid passage 206, which may be formed by, for example, the lower portion 236 of the fluid passage 206 extending horizontally from an inner threaded portion 204 to an outer threaded portion 202 of the lid 200, such that the lower portion 236 of the fluid passage 206 contacts the outer threaded portion 202 of the lid. In an exemplary embodiment, the fluid passage 206 may then extend upwards along the wall of the lid 200, either in a combined wall 238 or separately. This can be contrasted with the embodiment of, for example, FIG. 2A, in which a combined wall 238 only extends downward from the top corner of the lid 200 to an intermediate point on the wall of the lid 200, after which the lower portion 236 of the fluid passage 206 may diverge from the combined wall 238 and may extend to the inner threaded portion 204.

Figure 3A:
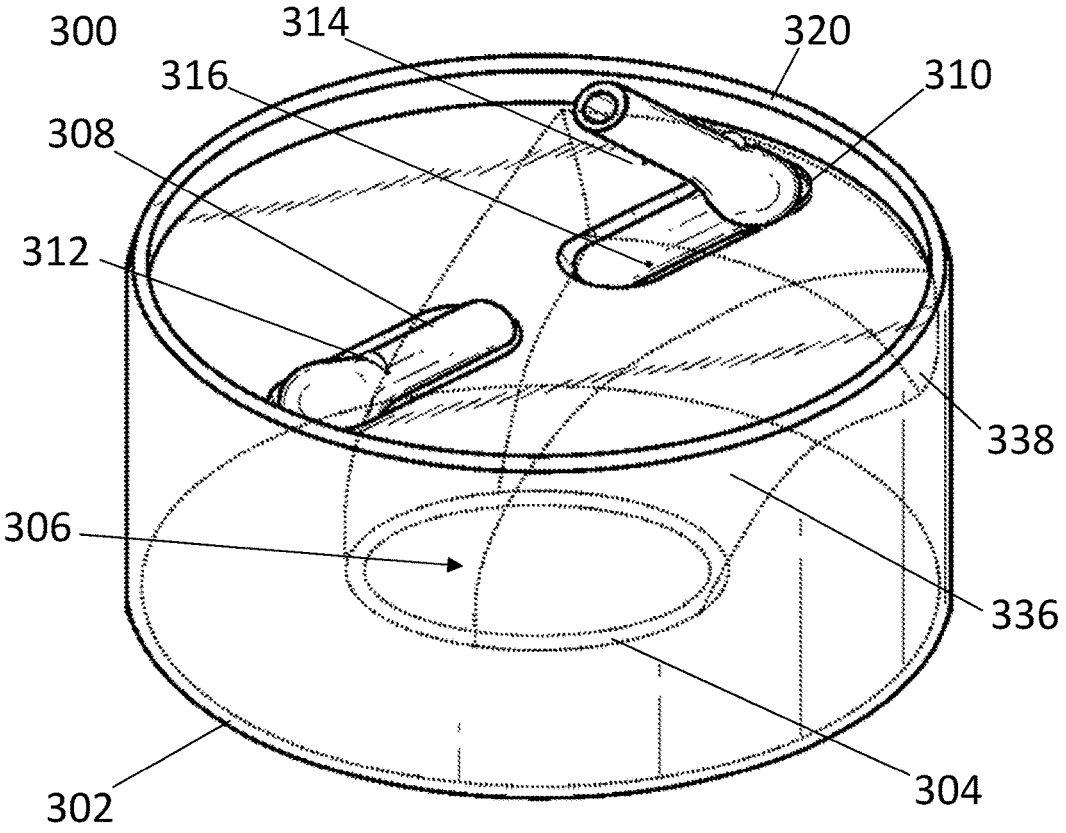
FIG. 3A is an exemplary embodiment of a lid of a drinking vessel.

Turning now to exemplary FIG. 3A, FIG. 3A displays an exemplary embodiment of a lid 300 configured to be attached to the body portion of a drinking vessel 100. As in the previous embodiment, a lid 300 may have a threaded outer portion 302, a threaded inner portion 304, and a fluid passage 306, as well as one or more closures allowing a user to drink the contents of the drinking vessel. Fluid passage 306 may have a lower portion 336 and an upper wall, which may be a combined wall 338 or may be separated from the lid 300, as desired. Lid 300 may also have a raised outer portion 320, if desired.

In an exemplary embodiment, these closures may be a plurality of mouthpieces 308. Mouthpieces 308 may be connected to a mouthpiece track 310, and may be adjustable in at least one degree of freedom (such as up and down). Mouthpieces 308 may include a raised portion, such as an opener grip 312, which may allow a user to more easily adjust the mouthpiece 308; mouthpieces 308 may also or may alternatively include a higher-friction portion or another component designed to enhance a user's grip on the mouthpiece, as desired. In an exemplary embodiment, a mouthpiece track 310 may be removable from the lid 300 and may be substituted for another closure, such as a straw, if desired.

In an exemplary embodiment, a mouthpiece track 310, or another portion of the lid 300, may contain one or more vent holes 316. In an exemplary embodiment, these vent holes 316 may be positioned such that, when a mouthpiece 308 is positioned in an open position, one or more of the vent holes 316 is exposed and allow the passage of air, while when a mouthpiece 308 is positioned in a closed position, the vent holes 316 are obstructed. In an exemplary embodiment, mouthpieces 308 may include one or more vent hole closing snaps 314 designed to interface with and obstruct vent holes 316, as desired; for example, when the mouthpiece 308 is in a closed position, the vent hole closing snap 314 may be pressed into a vent hole 316, sealing it. In some exemplary embodiments, mouthpieces 308 may be removable during use, and may be substitutable for another type of closure, as desired. Alternatively, in another exemplary embodiment, a different type of closure may be used, other than a mouthpiece 308, as desired.

Figure 3B:
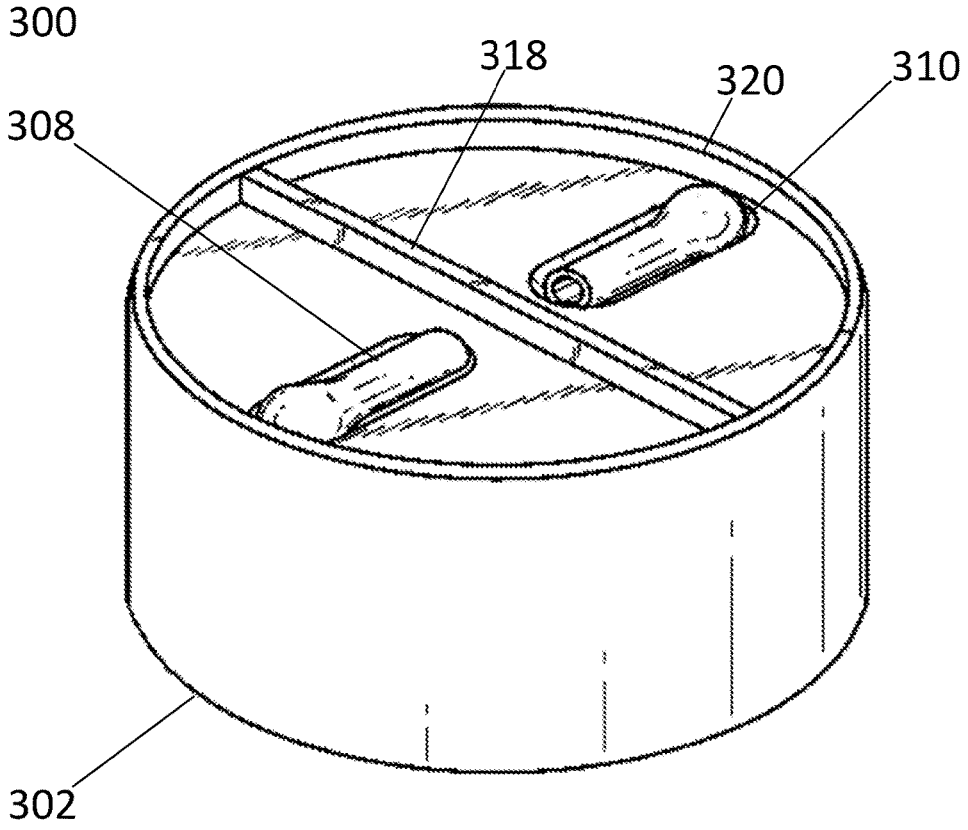
FIG. 3B is an exemplary embodiment of a lid of a drinking vessel.

Turning now to exemplary FIG. 3B, FIG. 3B displays an exemplary embodiment of a lid 300 configured to be attached to the body portion of a drinking vessel 100. According to an exemplary embodiment, one or more mouthpieces 308 of the lid 300 may not have opener grips 312, and may be configured to be opened, for example, by the action of a person placing their finger on the open part of the mouthpiece and pulling upward. In an embodiment, this may give the mouthpieces a lower profile, allowing the lid 300 to be capped in order to secure it from the elements with a cap that can be smaller than otherwise would be necessary.

In an embodiment, a lid 300 may also have a dividing wall 318 placed to divide the mouthpieces 308 or other closures from each other. This may help ensure that the contents of the drinking vessel do not spill or mix on the lid 300, should any of the contents spill or leak from one of the mouthpieces 308 or other closures. In an embodiment wherein a cap is provided for the lid, either or both of the raised outer portion 320 and the dividing wall 318 may have one or more fixtures upon which the cap can be secured, as desired.

Figure 4:
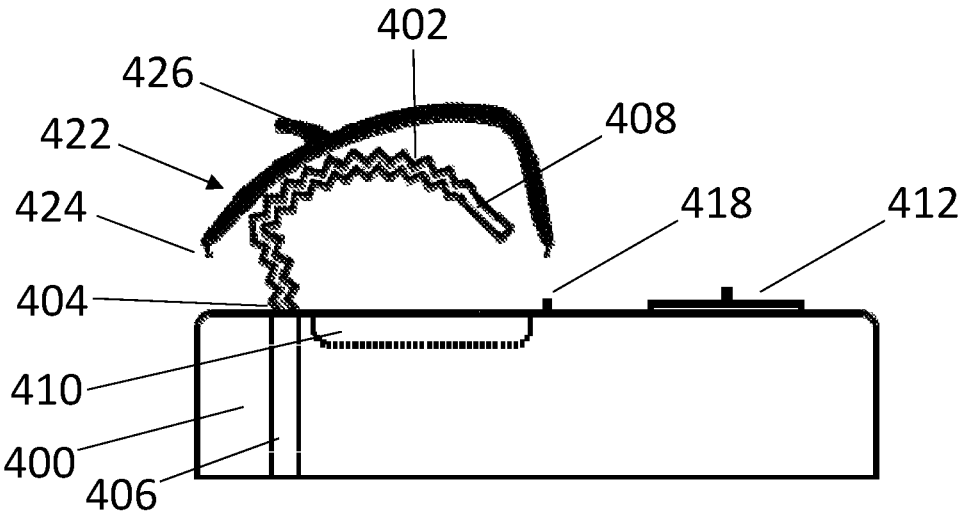
FIG. 4 is an exemplary embodiment of a lid of a drinking vessel.

Turning now to exemplary FIG. 4, FIG. 4 displays an exemplary embodiment of a lid 400 configured to be attached to the body portion of a drinking vessel 100. In an exemplary embodiment, a lid 400 may have, as one or more of its closures, a closure constituting a flexible straw 402 and an opening 404, through which the straw 402 can be inserted or through which the straw 402 fixedly extends. In some embodiments, an opening 404 may be separately closable, which may allow the straw 402 to be removed and stored separately; in other embodiments, a straw 402 may be fixedly held within the opening 404. Opening 404 may be fluidically connected to a fluid passage 406.

In some embodiments, a flexible straw 402 may be paired with other closures, such as a sipper or mouthpiece 412. In an embodiment, this may provide a configuration in which one of the compartments of the drinking vessel may be used for cold drinks and accessed with the flexible straw 402, and wherein another of the compartments of the drinking vessel may be used for hot drinks and accessed with the sipper or mouthpiece 412. In other embodiments, multiple flexible straws 402 may be used, or closures may be substituted for one another, as desired.

In some embodiments, a flexible straw 402 may be sealable. In one exemplary embodiment, the end 408 of the flexible straw 402 may be straight and rigid, such that the end 408 of the straw 402 can be sealed with an attachable cap. In another exemplary embodiment, the straw 402 may be highly flexible and may be configured to bend and lay down in a groove, such as a straw or mouthpiece track 410 (or a comparable structure adapted to hold the straw), which may be located on top of the lid 400, around the perimeter of the lid 400, or elsewhere on the lid 400, as may be desired. According to an exemplary embodiment, a user may lift the flexible straw 402 from the flexible straw track 410 in order to access the contents of the drinking vessel, and may push the flexible straw 402 back into the flexible straw track 410 in order to seal the closure when not in use.

In an exemplary embodiment, the lid 400 may include a removable cap 422, which may fit over one or both of the closures of the lid 400, and which may serve to protect one or more of the closures of the lid 400 from the outside environment. In an embodiment, a removable cap 422 may provide space in which a straw 402 can be stored, reducing the necessary size of a straw track 410. Alternatively, in some embodiments, multiple removable caps 422 may be used, for example one such cap 422 for each closure. For example, according to an exemplary embodiment, a removable cap 422 may be pressed onto a flexible straw 402, compressing the flexible straw 402 into a flexible straw track 410, and may then be secured in place on the lid 400. In another exemplary embodiment, the removable cap 422 may be used to house the closure, such as a flexible straw 402, in its entirety, and no flexible straw track 410 may be present. In some embodiments, the removable cap 422 may be sized to fit over all of the closures on the lid 400; in other embodiments, one or more closures, such as a sipper or mouthpiece 412, may be left exposed, if desired.

In an exemplary embodiment, a removable cap 422 may have a plurality of connectors 424 disposed on the lower portion of the removable cap 422, and may connect to the rim of the lid 400 on one side of the removable cap 422 and may connect to a dividing wall 418 of the lid 400 on the other side of the removable cap 422. Removable cap 422 may include a pull-tab 426 by which it may be easily removed from the lid 400, if desired.

In some exemplary embodiments, the removable cap 422 may contain an insulating air or vacuum pocket or may otherwise be insulated. In other exemplary embodiments, the removable cap 422 may create an airtight seal between the removable cap 422 and the lid 400, which may have an insulating effect when the removable cap 422 is secured on the lid 400. In other exemplary embodiments, the removable cap 422 may merely function to protect one or more of the closures or store a removable drinking mechanism such as a flexible straw 402.

The foregoing description and accompanying figures illustrate the principles, preferred embodiments and modes of operation of the invention. However, the invention should not be construed as being limited to the particular embodiments discussed above. Additional variations of the embodiments discussed above will be appreciated by those skilled in the art (for example, features associated with certain configurations of the invention may instead be associated with any other configurations of the invention, as desired).

Therefore, the above-described embodiments should be regarded as illustrative rather than restrictive. Accordingly, it should be appreciated that variations to those embodiments can be made by those skilled in the art without departing from the scope of the invention as defined by the following claims.

What is claimed is:

1. A multiple-chambered drinking vessel, comprising:

a body portion, the body portion comprising a sidewall forming an outer compartment, and further comprising an inner compartment affixed to the body portion and concentrically arranged in the outer compartment, each of the outer compartment and the inner compartment being open at the top and having a threaded upper portion; and a lid, the lid comprising an outside rim adapted to sealably interface with the threaded upper portion of the outer compartment, and comprising a fluid passage having a fluid passage rim adapted to sealably interface with the threaded upper portion of the inner compartment;

the lid further comprising a plurality of closures shiftable between an open and a closed state, the closures each unsealing at least one vent hole when in an open state and sealing the at least one vent hole when in a closed state, wherein an outer compartment closure in the plurality of closures is configured to unseal a fluid orifice of the outer compartment when in an open state and seal the fluid orifice of the outer compartment when in a closed state, and wherein an inner compartment closure in the plurality of closures is configured to unseal a fluid orifice of the fluid passage when in an open state and seal the fluid orifice of the fluid passage when in a closed state.

2. The multiple-chambered drinking vessel of claim 1, wherein each of the plurality of closures comprises a sipper, each of the sippers comprising a sipper panel and a sliding closure slidable on the sipper panel.

3. The multiple-chambered drinking vessel of claim 2, wherein each of the sippers further comprises a restoring component configured to apply a force to the sliding closure of the sipper when in an open state, the force tending to move the sliding closure of the sipper to a closed state.

4. The multiple-chambered drinking vessel of claim 1, wherein each of the plurality of closures comprises a mouthpiece track and a mouthpiece coupled to the mouthpiece track and adjustable in at least one degree of freedom.

5. The multiple-chambered drinking vessel of claim 4, wherein each of the mouthpieces further comprises a vent hole closing snap adapted to interface with and obstruct a vent hole, such that when the mouthpiece is in a closed state the vent hole is sealed by the vent hole closing snap, and such that when the mouthpiece is in an open state the vent hole is unsealed.

6. The multiple-chambered drinking vessel of claim 1, wherein the lid further comprises a contiguous raised portion disposed around the perimeter of the lid, and a dividing wall disposed between two of the plurality of closures.

7. The multiple-chambered drinking vessel of claim 1, wherein the inner compartment is insulated from the outer compartment.

8. A multiple-chambered drinking vessel, comprising:

a body portion, the body portion comprising a sidewall forming an outer compartment, and further comprising an inner compartment removably coupled to the body portion at a mounting site of the body portion, the mounting site and the inner compartment each being concentrically arranged in the outer compartment, each of the outer compartment and the inner compartment being open at the top and having a threaded upper portion; and a lid, the lid comprising an outside rim adapted to sealably interface with the threaded upper portion of the outer compartment, and comprising a fluid passage having a fluid passage rim adapted to sealably interface with the threaded upper portion of the inner compartment;

the lid further comprising a plurality of closures shiftable between an open and a closed state, the closures each unsealing at least one vent hole when in an open state and sealing the at least one vent hole when in a closed state, wherein an outer compartment closure in the plurality of closures is configured to unseal a fluid orifice of the outer compartment when in an open state and seal the fluid orifice of the outer compartment when in a closed state, and wherein an inner compartment closure in the plurality of closures is configured to unseal a fluid orifice of the fluid passage when in an open state and seal the fluid orifice of the fluid passage when in a closed state.

9. The multiple-chambered drinking vessel of claim 8, wherein each of the plurality of closures comprises a sipper, each of the sippers comprising a sipper panel and a sliding closure slidable on the sipper panel.

10. The multiple-chambered drinking vessel of claim 9, wherein each of the sippers further comprises a restoring component configured to apply a force to the sliding closure of the sipper when in an open state, the force tending to move the sliding closure of the sipper to a closed state.

11. The multiple-chambered drinking vessel of claim 8, wherein each of the plurality of closures comprises a mouthpiece track and a mouthpiece coupled to the mouthpiece track and adjustable in at least one degree of freedom.

12. The multiple-chambered drinking vessel of claim 11, wherein each of the mouthpieces further comprises a vent hole closing snap adapted to interface with and obstruct a vent hole, such that when the mouthpiece is in a closed state the vent hole is sealed by the vent hole closing snap, and such that when the mouthpiece is in an open state the vent hole is unsealed.

13. The multiple-chambered drinking vessel of claim 8, wherein the lid further comprises a contiguous raised portion disposed around the perimeter of the lid, and a dividing wall disposed between two of the plurality of closures.

14. The multiple-chambered drinking vessel of claim 8, wherein the inner compartment is insulated from the outer compartment.

15. The multiple-chambered drinking vessel of claim 8, wherein the inner compartment is liquid-permeable.

16. The multiple-chambered drinking vessel of claim 8, wherein the mounting site comprises at least one of a threaded connection, a snap fit, or a press fit.

17. The multiple-chambered drinking vessel of claim 8, further comprising a second inner compartment configured to be exchangeable with the inner compartment and attachable to the mounting site of the body portion.

18. A multiple-chambered drinking vessel, comprising:

a body portion, the body portion comprising a sidewall forming an outer compartment, the outer compartment being open at the top and having a threaded upper portion;

an inner compartment, the inner compartment being open at the top and having a threaded upper portion; and a lid, the lid comprising an outside rim adapted to sealably interface with the threaded upper portion of the outer compartment, and comprising a fluid passage having a fluid passage rim adapted to sealably interface with the threaded upper portion of the inner compartment such that the inner compartment is suspended under the lid and concentrically arranged within the outer compartment;

the lid further comprising a plurality of closures shiftable between an open and a closed state, the closures each unsealing at least one vent hole when in an open state and sealing the at least one vent hole when in a closed state, wherein an outer compartment closure in the plurality of closures is configured to unseal a fluid orifice of the outer compartment when in an open state and seal the fluid orifice of the outer compartment when in a closed state, and wherein an inner compartment closure in the plurality of closures is configured to unseal a fluid orifice of the fluid passage when in an open state and seal the fluid orifice of the fluid passage when in a closed state.

19. The multiple-chambered drinking vessel of claim 18, wherein each of the plurality of closures comprises a sipper, each of the sippers comprising a sipper panel and a sliding closure slidable on the sipper panel.

20. The multiple-chambered drinking vessel of claim 18, wherein each of the plurality of closures comprises a mouthpiece track and a mouthpiece coupled to the mouthpiece track and adjustable in at least one degree of freedom.

* * * * *